US008044864B2

(12) United States Patent
Huchard et al.

(10) Patent No.: US 8,044,864 B2
(45) Date of Patent: Oct. 25, 2011

(54) ANTENNA AND ASSOCIATED MEASUREMENT SENSOR

(75) Inventors: Mathieu Huchard, Verrieres le Buisson (FR); Christophe Delaveaud, Saint Jean de Moirans (FR)

(73) Assignee: Commissariat A l'Energie Atomique, Paris (FR)

( * ) Notice: Subject to any disclaimer, the term of this patent is extended or adjusted under 35 U.S.C. 154(b) by 346 days.

(21) Appl. No.: 12/374,294

(22) PCT Filed: Jul. 17, 2007

(86) PCT No.: PCT/EP2007/057351

§ 371 (c)(1), (2), (4) Date: Jan. 16, 2009

(87) PCT Pub. No.: WO2008/009667

PCT Pub. Date: Jan. 24, 2008

(65) Prior Publication Data

US 2009/0322631 A1 Dec. 31, 2009

(30) Foreign Application Priority Data

Jul. 21, 2006 (FR) ..... 06 53071

(51) Int. Cl.
*H01Q 1/38* (2006.01)

(52) U.S. Cl. ..... 343/700 MS; 343/702

(58) Field of Classification Search ..... 343/700 MS, 343/702, 895

See application file for complete search history.

(56) References Cited

U.S. PATENT DOCUMENTS

| | | | | |
|---|---|---|---|---|
| 6,618,016 | B1 | 9/2003 | Hannan et al. | |
| 7,427,955 | B2 * | 9/2008 | Choi et al. | 343/700 MS |
| 2006/0145926 | A1 | 7/2006 | Choi et al. | |

FOREIGN PATENT DOCUMENTS

| | | | |
|---|---|---|---|
| FR | 2751471 | A1 | 1/1998 |
| WO | 2005004283 | A | 1/2005 |
| WO | 2008009667 | A1 | 1/2008 |

* cited by examiner

*Primary Examiner* — Hoang V Nguyen
(74) *Attorney, Agent, or Firm* — Nixon Peabody LLP

(57) ABSTRACT

An antenna which comprises four elementary IFA antennae, each elementary IFA antenna comprising a ground plane (1), a roof (2), a short-circuit (3) between the ground plane and the roof and an excitation means (4), the four elementary IFA antennae being distributed around an axis (Oz) in a first set of two IFA antennae having substantially equivalent elementary radiations and a second set of two IFA antennae having equivalent elementary radiations, the excitation means (4) of the four elementary IFA antennae being fed by radiofrequency signals of like amplitude whereof the phases follow a law which is substantially progressive in quadrature by rotation around the axis.

15 Claims, 6 Drawing Sheets

ANTENNA AND ASSOCIATED MEASUREMENT SENSOR

CROSS REFERENCE TO RELATED APPLICATIONS OR PRIORITY CLAIM

This application is a national phase of International Application No. PCT/EP2007/057351, entitled "ISOTROPIC ANTENNA AND ASSOCIATED MEASUREMENT SENSOR", which was filed on Jul. 17, 2007, and which claims priority of French Patent Application No. 06 53071, filed Jul. 21, 2006.

DESCRIPTION

Technical Field and Prior Art

The invention concerns an isotropic antenna able to transmit or receive an electromagnetic field over a large frequency spectrum. The invention also concerns a sensor for measuring measurable quantity which comprises an antenna according to the invention.

The invention is applicable to communicating objects which are small in size compared to the wavelengths used for communication. Typically, the objects concerned by the invention are terminals having dimensions in the vicinity of several centimeters operating on ISM (Industrial Scientific Medical), UHF (Ultra High Frequency), VHF (Very High Frequency), SHF (Super High Frequency), EHF (Extremely High Frequency) bands.

The antennae which equip such terminals have reduced dimensions relative to the operating wavelengths λ (dimensions typically smaller than 0.5λ). This specificity of the antennae defines a category of antennae commonly called "miniature antennae".

The proposed antenna is an antenna which is applicable, among other things, to low-range, low-bandwidth and low consumption applications such as, for example:

- wireless networks for dispersed sensors: building surveillance, environmental surveillance, sensors used in industrial settings;
- home automation: switches, remote controls, etc.;
- accessories for personal networks such as hands-free kits, computer mouse, digital pens, etc.;
- movement sensors (objects, living things);
- electromagnetic field measurement probes.

The applications primarily concerned by the invention are applications for which the orientation of one or several apparatuses designed to transmit together is random and changing. The quality of the radio connection must, however, remain constant regardless of the orientation. One therefore is ideally seeking an antenna with substantially isotropic radiation characteristics. The proposed invention aims to resolve this problem.

Traditionally, the antennae used to date in the abovementioned applications are of the omnidirectional type, but one does, however, note that they still have directions in which the radiation is null. Transmission is therefore impossible in these directions.

A second aspect damaging the quality of transmission is the polarization mismatching of the waves transmitted or received by the antenna. When the polarization of the waves is linear, a tilt of the antennae relative to each other can lead to orthogonal directions of polarization. In such a case, the transmitted power becomes null.

The search for antenna structures having isotropic radiations began in the years from 1960 to 1970 for spatial applications. It continued into the 1990s. The problem which was then posed was the following: how to keep a constant radio connection with a satellite or a spatial probe whereof the orientation can vary in any manner during a transmission? All of the proposed solutions were antennae with large dimensions, i.e. the dimensions of which are equal to several times the operating wavelength. Their operating principle does not make it possible to miniaturize such antennae. For this reason and due to their unsuitable duty cycle, they cannot be transposed into the fields of application of the communicating objects of the invention.

With regard to miniature antennae, two examples of antenna structure from the prior art and their operating principles are presented below.

FIG. 1 illustrates a first example of a miniature antenna structure of the prior art. Two dipoles D1, D2 of half-wave length are arranged orthogonally. The feed signals V1 and V2 of the respective dipoles D1 and D2 are applied to the crossing of the two dipoles. The feeds are in phase quadrature:

$$V2=V1e^{j\pi/2}$$

The radiation of a dipole is created by a distribution of current which is established, along the dipole, according to a half-wave resonance mode. The radiation produced is then maximum in the direction orthogonal to the dipole and is null in the direction of the dipole. Due to the arrangement in a cross of the two dipoles and their phase quadrature feed, the direction of maximal radiation of one corresponds to the direction of null radiation of the other. The assembly of the two dipoles therefore radiates in every direction. The radiation is thus quasi-isotropic in power. In fact, the characteristics of the radiation emitted are the following:

- the gap between the minimum and the maximum power emitted is typically 4.7 dB (which is considered "good" power isotropy);
- the polarization of the waves emitted is circular in the direction perpendicular to the plane of the dipoles and rectilinear in the plane of the dipoles;
- the typical bandwidth of the transmitted waves is substantially equal to 10% of the central frequency.

FIGS. 2A and 2B illustrate a second example of a miniature antenna structure of the prior art. The antenna illustrated in FIGS. 2A and 2B is an antenna commonly called an inverted F-antenna (IFA).

An IFA is made up of an electrically conductive plane 1 (ground plane), a wire or planar metallic piece 2, commonly called the "roof" of the antenna, most often arranged parallel to the ground plane (but which can also not be parallel to the ground plane), an electrically conductive connection 3 placed at a first end of the roof, in a first plane perpendicular to the ground plane and which short-circuits the roof and the ground plane, and an excitation means 4, for example a wire probe, placed in a second plane perpendicular to the ground plane and which is connected to a radiofrequency source RF which creates a difference in potential between the roof and the ground plane. The second end of the roof 2 is in open circuit. The ground plane 1 preferably has larger dimensions than the roof such that, from a geometric perspective, the projection of the roof over the ground plane is located entirely inside the ground plane.

The roof 2, the short-circuit 3 and the excitation means 4 form, seen in profile, an inverted F which is at the origin of the antenna's name (cf. FIG. 2A). The length 12 of the roof 2 is substantially equal to λg/4, where λg is the guided wave length of the antenna. The distance h which separates the roof 2 from the ground plane 1 is on average equal to a small fraction of the wavelength λg, for example λg/20, and the distance d which separates the plane in which the short-circuit is placed from the plane in which the excitation means is placed is chosen in order to adapt the impedance of the antenna to the source RF. A quarter-wave resonance mode is established between the roof 2 and the ground plane.

An antenna of this type is not isotropic. It has one direction which has a strong attenuation and this attenuation is more significant when the ground plane is large. The gap between the minimum and maximum power transmitted by the antenna varies from 9.5 dB to 28 dB. The value of 9.5 dB is obtained for a ground plane with small dimensions (i.e. $l1=0.22\ \lambda g$) and the value of 28 dB for a ground plane with large dimensions (i.e. $l1=0.4\ \lambda g$).

With regard to the polarization, it is close to a linear state over the entire radiation diagram, except for two reduced opening lobes for which the polarization is quasi-circular. The uniformity in circular polarization is therefore relatively poor. The bandwidth is typically equal to 1.25% of the central frequency.

The miniature antennae of the prior art have many drawbacks. The miniature antenna of the invention does not present these drawbacks.

BRIEF DESCRIPTION OF THE INVENTION

Indeed the invention concerns an antenna which comprises four elementary IFA antennae, each elementary IFA antenna comprising a ground plane, a roof, a short-circuit between the ground plane and the roof and an excitation means, the four elementary IFA antennae being distributed around an axis in a first set of two IFA antennae having substantially equivalent far field elementary radiations and a second set of two IFA antennae having substantially equivalent far field elementary radiations, the two IFA antennae of the first set being aligned according to a first alignment axis substantially perpendicular to the axis and the two IFA antennae of the second set being aligned according to a second alignment axis substantially perpendicular to the axis, the first alignment axis and the second alignment axis crossing each other at a right angle at one point of the axis, the excitation means of the four elementary IFA antennae being fed by radiofrequency signals of like amplitude whereof the phases follow a law which is substantially progressive in quadrature by rotation around the axis (0°, 90°, 180°, 270°).

According to one additional characteristic of the invention, the two elementary IFA antennae of a same set of two antennae are identical and symmetrical relative to the axis.

According to another additional characteristic of the invention, the four elementary IFA antennae are all identical.

According to still another additional characteristic of the invention, the roofs of the four elementary IFA antennae are distributed on a flat surface substantially perpendicular to the axis.

According to still another additional characteristic of the invention, the roofs of the four elementary IFA antennae are substantially inscribed in a circle.

According to still another additional characteristic of the invention, the roofs of the four elementary IFA antennae are substantially inscribed in an ellipsis.

According to still another additional characteristic of the invention, the roofs of the four elementary IFA antennae are distributed on a substantially conical closed surface.

According to still another additional characteristic of the invention, the roofs of the four elementary IFA antennae are distributed on a cylindrical surface whereof the generatrix is parallel to the axis.

According to still another additional characteristic of the invention, the cylindrical surface is a cylindrical surface whereof the directing curve draws a circle, or a square, or a rectangle.

According to still another additional characteristic of the invention, the roofs of the four elementary IFA antennae are formed by metallizations realized on a same substrate.

According to still another additional characteristic of the invention, the ground planes of the four elementary IFA antennae are formed by a same conductive layer.

According to still another additional characteristic of the invention, the antenna comprises means to switch the progressive law in quadrature between a first direction of rotation around the axis and a second direction of rotation around the axis, opposite the first direction.

The invention also concerns a sensor for measuring measurable quantity comprising means for measuring a measurable quantity and a transmitter provided with an antenna able to transmit the measurement of the measurable quantity in the form of a modulation of an electromagnetic wave emitted by the transmitter, wherein the antenna is an antenna according to the invention.

An antenna according to the invention is made up of an association of four elementary IFA antennae. Preferably, an antenna according to the invention comprises a single ground plane, four electrically conductive patterns placed above the ground plane and each forming an IFA antenna roof, four short-circuit connections and four excitation means.

The four elementary IFA antennae are grouped according to two sets of two antennae, the two IFA antennae of a same set being designed such that their far field elementary radiations are equivalent.

Two IFA antennae have equivalent far field elementary radiations when, being placed independently in the same marker with the same orientation, they radiate, in the useful frequency band, a wave of like amplitude and like phase in each direction of the space.

A simple means for obtaining two IFA antennae with equivalent elementary radiations consists of realizing identical antennae, i.e. having the same geometry (same shape and same dimensions).

It is, however, possible to realize two IFA antennae having different shapes or dimensions and having, despite everything, equivalent elementary radiations. Examples of such antennae will be described later, in reference to FIGS. 10A and 10B.

The ground plane of an antenna of the invention is formed by a conductive element whereof the surface can allow, if necessary, stores of metallization and electronic components. The surface of the ground plane can be a flat surface which is circular, elliptical, square, rectangular in shape, a conical surface, a surface which closes on itself of the cylindrical, cubic or parallelepiped type, etc. In general, the surface which defines the ground plane has a symmetry relative to an axis. The surface of the ground plane has dimensions greater than or equal to the surface on which the electrically conductive patterns forming roofs are integrated such that, from a geometrical perspective, the projection, over the ground plane, of the surface in which the electrically conductive patterns forming roofs are integrated is located entirely inside the ground plane. The radiation of the antenna is more isotropic in power when the ground plane is small. This is why the ground plane will preferably be chosen with dimensions equal to the dimensions of the surface in which the electrically conductive patterns forming roofs are integrated. The ground plane will most often have larger dimensions when it has, for integration reasons, a circuit support function such as, for example, the RF circuit which feeds the elementary IFA antennae.

The RF circuit which feeds the four feed connections can indeed be realized on the upper or lower surface of the ground plane. The influence of its presence on the radiation of the antenna is negligible when it is correctly designed. Different possibilities for realizing the feed circuit are possible in the form of a parallel or serial network of microwave strips which may or may not include localized elements (coupling units, phase changers, etc.).

The patterns forming roofs can be wires or flat elements whereof the contours can have quite varied shapes: rectangular, trapezoidal, elliptical, folded in an arc or not, rounded ends or not, the general shape of a pattern and its dimensions greatly determining the radiation characteristics of the antenna, in particular its operating frequency. The patterns are arranged either parallel to the ground plane, or tilted by an angle relative thereto (the tilt angle of the patterns can, for example, be equal to 30° and can reach 45° or even more). The patterns can be realized on substrate using printed circuit techniques or machining of conductive pieces, for example metallic.

According to the preferred embodiment of the invention, the patterns are grouped into a first pair of identical patterns and a second pair of identical patterns. The patterns of one pair of identical patterns are aligned along an alignment axis perpendicular to the axis Oz of the antenna, the two alignment axes of the two pairs of patterns crossing at a right angle on the axis of the antenna. Also, the two conductive connections forming short-circuit between the ground plane and the ends of the conductive patterns of a pair of conductive patterns are arranged symmetrically relative to the axis Oz. The same is true for the two excitation means connected to the two conductive patterns of a same pair of conductive patterns.

The four excitation means feed the four IFA antennae with signals of substantially equal amplitudes, phase shifted according to a law which is progressive in phase quadrature such that, for antennae a1-a4 which follow each other around the axis Oz (in the clockwise direction or the counterclockwise direction), it comes:

| No. | a1 | a2 | a3 | a4 |
|---|---|---|---|---|
| Phase shift | 0° | 90° | 180° | 270° |

Two IFA antennae aligned along an axis perpendicular to the axis of the antenna are strongly coupled (typically −3 to −4 dB). Their feeds are in opposite phase (180°) but, due to their opposite orientations, their resonances are phased. The coupling phenomenon is beneficial here because it advantageously allows a reduction of the length L of the roofs of the two IFA antennae which are across from each other compared to the case of a single isolated IFA having the same operating frequency. The dimension L can thus be less than $\lambda/4$. The set is thus smaller than the simple combination of dipoles in a cross, which is an advantage related to the invention.

Likewise, contrary to the combination of dipoles in a cross for which the coupling between dipoles is weak (<−40 dB), the coupling between two elementary IFA antennae of the invention whereof the roofs are perpendicular to each other is significant (−2 to −3 dB). The electrical field concentrated between the ground plane and the roof of the antenna is oriented in the normal direction relative to the ground plane. When two IFA antennae are arranged on the same ground plane, their field lines are oriented in the same direction perpendicular to the ground plane. Strong coupling then occurs between them. This coupling depends on the distance between the antennae and depends little on their orientations. For this reason, it is impossible to arrange two IFA antennae in a cross according to the operating principle of the dipoles in a cross. The strong coupling would not allow feeding of the IFA antennae independently in phase quadrature.

In the framework of the invention, coupling between the orthogonal pairs of IFA antennae is decreased due to the central space left between them. Coupling is thus typically brought to between −7 dB and −10 dB, which allows feeding with a 90° phase shift between adjacent IFA antennae. The space between the IFA antennae tends to increase the total dimensions of the set of antennae and therefore constitutes a limit for the miniaturization of the antenna. However, this is partially offset by the coupling phenomenon previously mentioned, thereby making it possible to decrease the length of each elementary IFA antenna.

From the perspective of electromagnetic performance, an isotropic antenna according to the invention advantageously has the following characteristics:

- Typically 3 to 6 dB gap between the maximum and minimum power radiated over all of the radiation pattern;
- Circular polarization in the normal direction to the plane of the antenna;
- Rectilinear polarization in the plane of the antenna;
- The polar coordinates $E_\theta$ and $E_\phi$ of the transmitted electrical field have equal amplitudes;
- The bandwidth relative to −10 dB is between 1 and 20% depending, in particular, on the feed circuit RF used and the characteristics of the elementary IFA antennae.

BRIEF DESCRIPTION OF THE FIGURES

Other characteristics and advantages of the invention will appear upon reading one preferred embodiment done in reference to the attached figures, in which.

DETAILED DESCRIPTION OF PREFERRED EMBODIMENTS OF THE INVENTION

FIGS. 3-9B illustrate different examples of antennae according to the preferred embodiment of the invention. According to the preferred embodiment of the invention, the patterns forming roofs for the IFA antennae are identical two by two, two identical patterns being aligned along an alignment axis perpendicular to the axis of the antenna.

Figure 1:
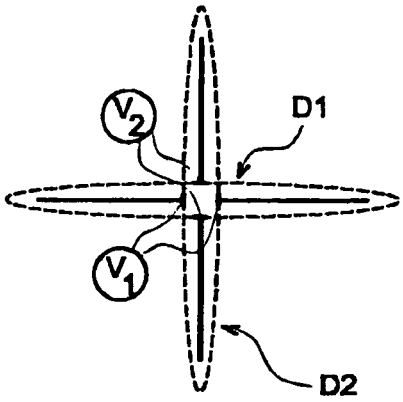
FIG. 1, already described, illustrates a first example of a miniature antenna structure of the prior art.
Figure 2A:
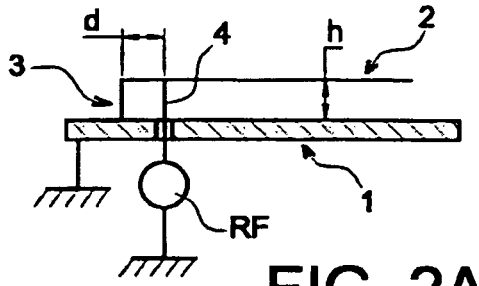
FIGS. 2A and 2B, already described, illustrate a second example of a miniature antenna structure of the prior art.
Figure 2B:
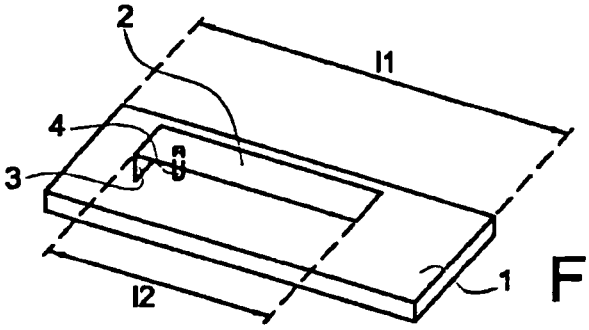
Figure 3:
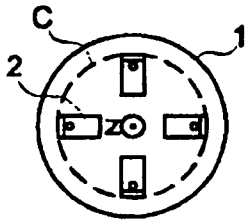
FIG. 3 illustrates a top view of a first example of an antenna according to the preferred embodiment of the invention.

FIG. 3 shows a first example of an antenna according to the preferred embodiment of the invention. The four conductor patterns 2 forming roofs for the IFA antennae are all identical (for example, in the shape of a rectangle) and inscribed in a circle C. The conductive connections which connect the conductor patterns forming roofs to the ground plane are placed at the outer ends of the patterns (i.e. substantially on the periphery of the circle C), in planes perpendicular to the plane of the figure. The patterns forming roofs can be discrete metallic elements or conductor elements realized on a same substrate.

Figure 4:
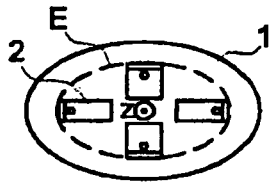
FIG. 4 illustrates a view of a second example of an antenna according to the preferred embodiment of the invention.

FIG. 4 illustrates a top view of a second example of an antenna according to the preferred embodiment of the invention. The four conductor patterns 2 in rectangle shape are distributed on an ellipsis E. The conductor patterns 2 can be discrete elements or elements realized on a same substrate.

Figure 5:
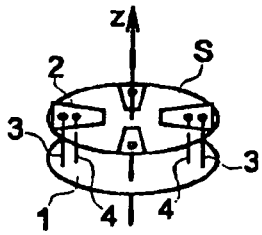
FIG. 5 illustrates a perspective view of a third example of an antenna according to the preferred embodiment of the invention.

FIG. 5 illustrates a perspective view of a third example of an antenna according to the preferred embodiment of the invention. The conductor patterns forming roofs 2 are in a parallelepiped shape. The patterns 2 are formed here on a same substrate S. They can also be discrete elements.

Figure 6:
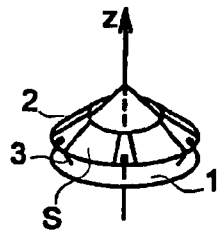
FIG. 6 illustrates a perspective view of a fourth example of an antenna according to the preferred embodiment of the invention.

FIG. 6 illustrates a perspective view of a fourth example of an antenna according to the preferred embodiment of the invention. The ground plane 1 has a conical surface and the conductor patterns 2 are arranged on a substrate which also has a conical shape. The axis of symmetry Oz is the axis of the cones here.

Figure 7:
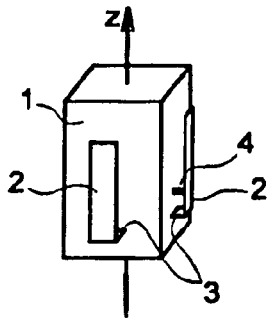
FIG. 7 illustrates a perspective view of a fifth example of an antenna according to the preferred embodiment of the invention.

FIG. 7 illustrates a perspective view of a fifth example of an antenna according to the preferred embodiment of the invention. The patterns forming roofs for the IFA antennae are distributed on a cylindrical surface whereof the generatrix is parallel to the axis of symmetry of the antenna and the directing curve of which draws a square.

Figure 8A:
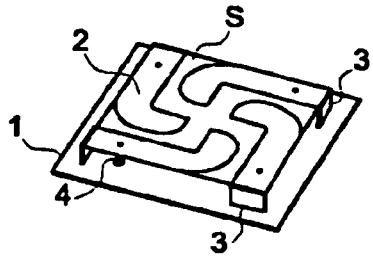
FIGS. 8A and 8B illustrate, respectively, a perspective view and a top view of a sixth example of an antenna according to the preferred embodiment of the invention.
Figure 8B:
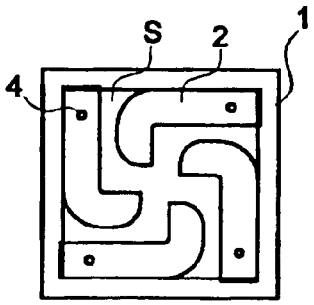

FIGS. 8A and 8B illustrate two views of a sixth example of an antenna according to the preferred embodiment of the invention. The patterns forming roofs of IFA antennae are located in a same plane perpendicular to the axis of the antenna and are bent so as to be inscribed in a square surface.

Figure 9A:
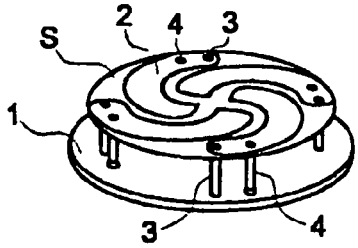
FIGS. 9A and 9B illustrate, respectively, a perspective view and a top view of a seventh example of an antenna according to the preferred embodiment of the invention.
Figure 9B:
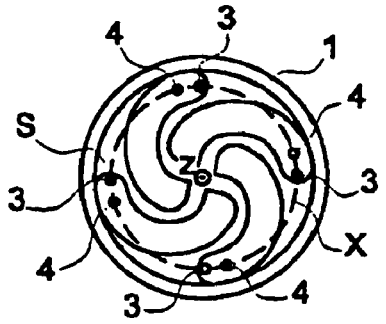

FIGS. 9A and 9B illustrate two views of a seventh example of an antenna according to the preferred embodiment of the invention. The patterns forming roofs for IFA antennae are located in a same plane perpendicular to the axis of the antenna and are folded in order to be inscribed in a circular surface. The patterns 2 are folded, for example, in spiral shapes. The patterns 2 are distributed on a circular substrate S placed across from a ground plane, which is also circular. The circles which define the ground plane and the substrate S are parallel and their centers are aligned along the axis Oz.

Figure 10A:
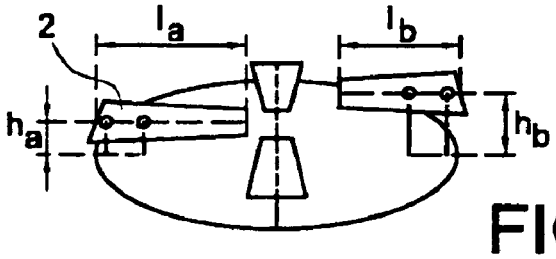
FIGS. 10A and 10B illustrate, respectively, a perspective view and a top view of examples of miniature antennae according to an embodiment different from the preferred embodiment of the invention.
Figure 10B:
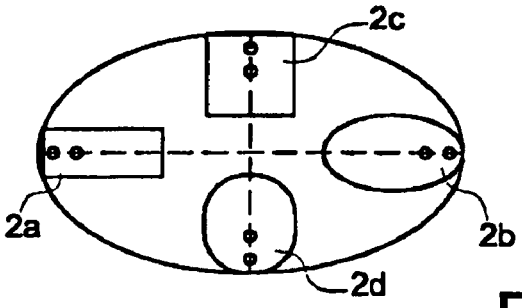

FIGS. 10A and 10B illustrate, respectively, a perspective view and a top view of examples of miniature antennae according to an embodiment different from the preferred embodiment of the invention. The two IFA antennae of a set of two aligned antennae have substantially equivalent far field radiations but their geometries are not identical.

FIG. 10A illustrates an example where two aligned elementary IFA antennae have roofs with different lengths 1*a*, 1*b* and different heights ha, hb relative to the ground plane. FIG. 10B illustrates another example where each pair of two aligned elementary IFA antennae comprises an antenna whereof the roof is rectangular in shape (2*a*, 2*c*) and another antenna whereof the roof is elliptical in shape (2*b*, 2*d*).

As a non-limiting example, a detailed description of an antenna corresponding to the seventh example of the preferred embodiment of the invention is given below.

The patterns forming roofs for IFA antennae are realized on an epoxy-glass substrate ($\epsilon_r$=4.4; tgδ=0.018=loss tangent) of 0.38 mm thickness covered by a copper metallization with a thickness of 17 μm. The patterns forming roofs are realized by photolithography. The ground connections 3 are located at the outer ends of the patterns 2. The connections 3 are copper wires with a diameter of 0.6 mm whereof a first end is welded to the pattern 2 and the other end to the ground plane. The feed wires 4 are also copper wires with a diameter of 0.6 mm. The ends of the ground wires 3 and the feed wires 4 which are located from the side of the substrate S are distributed on a circle X.

The distance which separates, on a same pattern 2, the end of the ground wire 3 from the end of the feed wire 4 is substantially equal to 3.6 mm. The distance which separates the ground plane 1 from the substrate S is substantially equal to 4 mm. The diameter of the substrate S is substantially equal to 25 mm and the diameter of the ground plane is larger than the diameter of the substrate S, for example equal to 30 mm. As already mentioned above, other values of the diameter of the ground plane are possible once the condition of a diameter larger than or equal to the diameter of the substrate S is met.

The antenna described above has an operating frequency substantially equal to 2.5 GHz. In a known manner, the bandwidth and the exact frequency of impedance adaptation also depend on the feed network used.

The gap between the minimum and the maximum power transmitted by the antenna is typically 5.6 dB, which corresponds to good power isotropy. The polarization of transmitted waves is circular along the axis Oz and rectilinear in the plane of the patterns 2. The average of the axial ratio pattern is substantially 49%.

For comparison, the table below shows the typical gap performance between maximum and minimum of the directivity pattern and average on the axial ratio pattern for the antenna of the invention and two antennae of the prior art, namely the combination of dipoles in a cross and the IFA antenna alone.

The gap between the maximum and minimum of the directivity pattern makes it possible to quantify the power isotropy. The weaker the latter, ideally null, the better the power isotropy. The average of the axial ratio pattern enables quantification of the uniformity of polarization relative to the circular state. An average of 100% means that the antenna radiates with a perfectly circular polarization in every direction.

| | Gap between maximum and minimum of the directivity pattern (dB) | Average over the axial ratio pattern |
|---|---|---|
| Combination of dipoles in cross | 4.7 dB | 46% |

-continued

| | Gap between maximum and minimum of the directivity pattern (dB) | Average over the axial ratio pattern |
|---|---|---|
| IFA antenna alone | >9.5 dB | 21% |
| Antenna according to the invention | 5.6 dB | 49% |

Figure 11A:
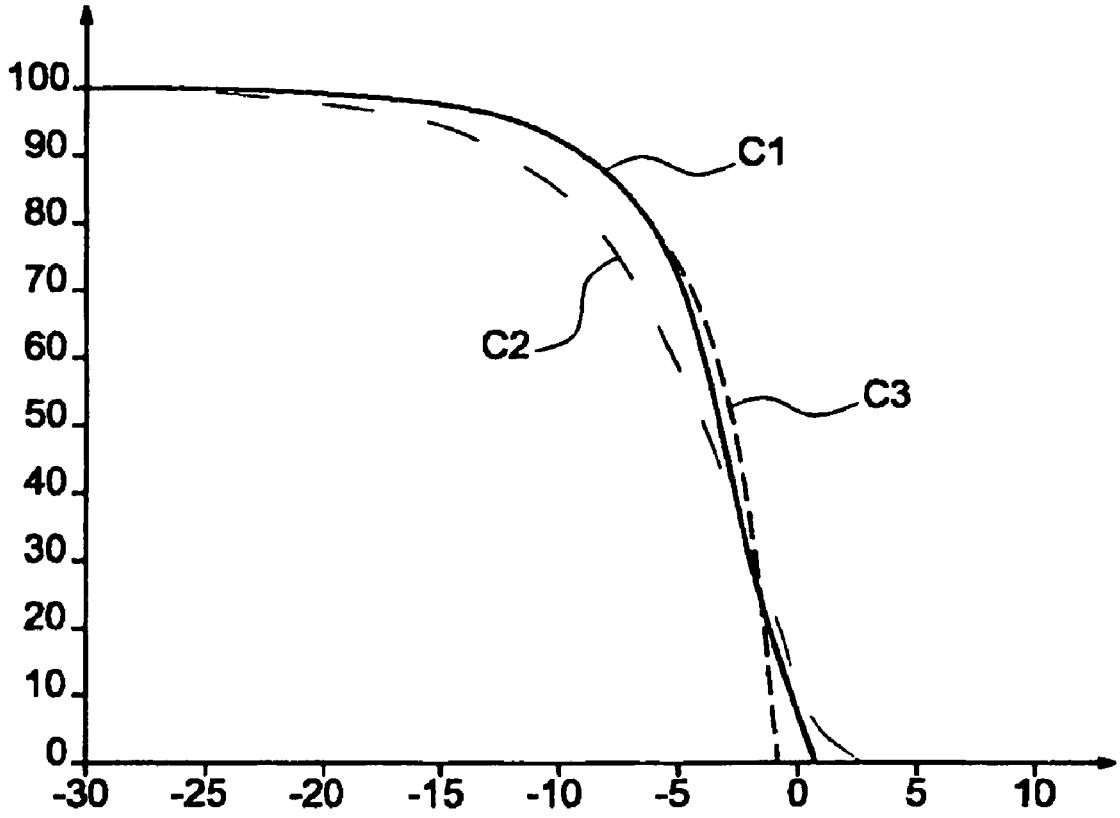
FIGS. 11A and 11B illustrate comparative curves of antennae coverage from the prior art and an antenna according to the invention.
Figure 11B:
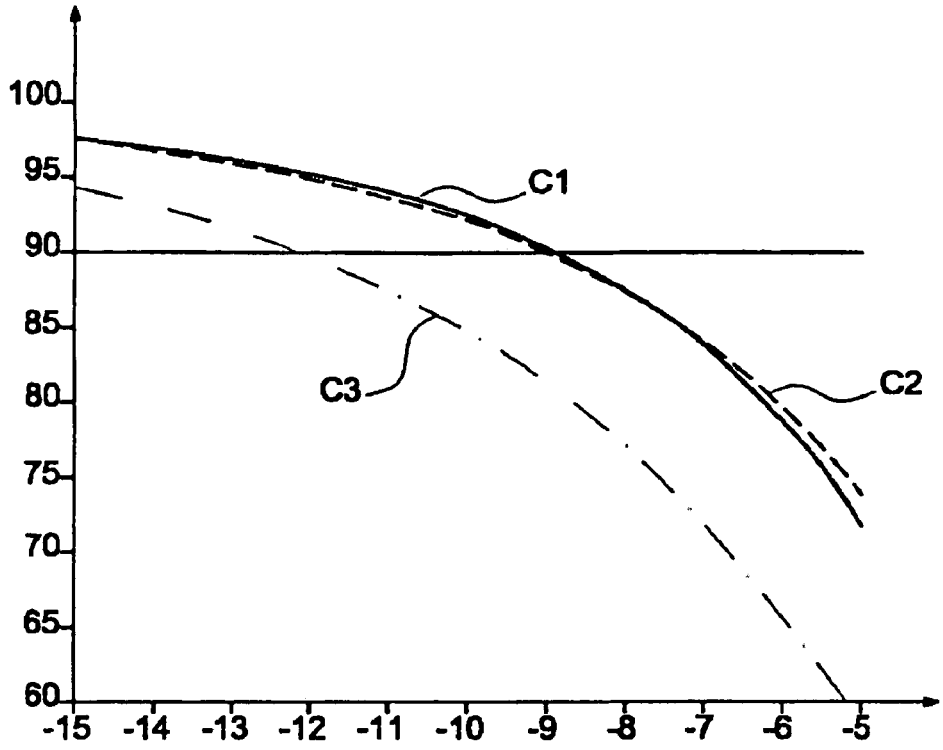
Figure 12:
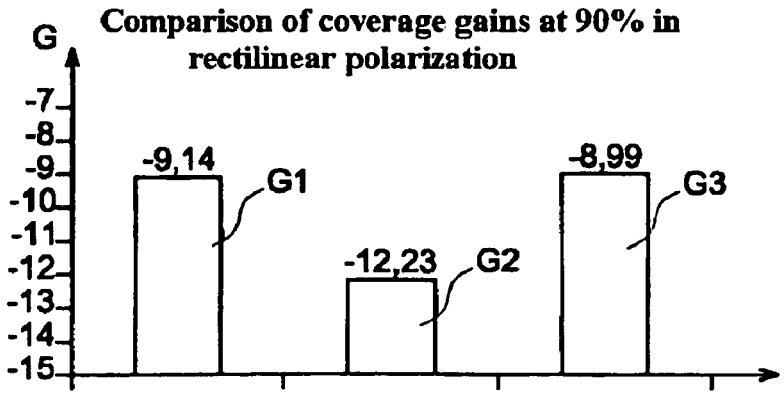
FIG. 12 illustrates a comparative histogram of the coverage gain at 90% in rectilinear polarization of antennae of the prior art and an antenna of the invention.

Another significant criterion enables comparison of the antennae to each other. This criterion is the coverage of the antennae. The coverage of an antenna is the proportion of orientation/tilt covered by the antenna according to the minimum power it receives when it is illuminated by an incident flat wave of unit power density. The coverage curves of the three abovementioned antennae (combination of dipoles in cross, IFA antenna alone and antenna according to the invention) are illustrated in FIGS. 11A and 11B. The ordinates of the curves 11A and 11B are expressed in percentages and the abscissa in decibels. FIG. 11B is a detailed view of FIG. 11A in the area corresponding to coverages above 60%. Moreover, FIG. 12 illustrates a comparative histogram of the coverage gain at 90%, in rectilinear polarization, for the three antennae considered: the gain G1 corresponds to the half-wave dipoles, the gain G2 corresponds to a single IFA antenna and the gain G3 corresponds to an antenna according to the invention.

The curves C1, C2, C3 of FIGS. 11A and 11B are the respective typical coverage curves of an antenna according to the invention (typical size λ/5), an IFA antenna alone and a combination of dipoles in a cross (typical size λ/2).

It emerges from these figures that the antenna according to the invention makes it possible to find all of the advantages of the combination of dipoles in a cross in the field of broad coverages despite its reduced size.

Figure 13:
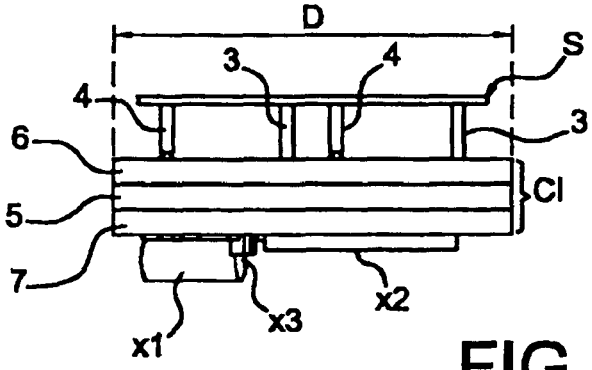
FIG. 13 illustrates a profile view of one embodiment of the sensor according to the invention.

FIG. 13 illustrates a profile view of an embodiment of a sensor provided with an antenna according to the invention. The antenna is, for example, an antenna as described in FIGS. 9A-9B.

The sensor comprises a multilayer printed circuit CI made up of an insulating layer 5 on which are deposited, on one side, a conductive layer 6 which constitutes the ground plane and, on the other side, a substrate 7 on which different circuits x1, x2, x3 are integrated such as integrated circuits, battery, sensor, feed network RF, etc. The dimensions of the sensor are small, such that the antenna is its most voluminous component. The diameter D of the sensor is thus typically equal to λ/5 or λ/4. This dimension is to be brought closer to the diameter λ/2 of the half-wave dipoles in cross. The realization of the sensor in printed circuit technology advantageously allows mass production thereof at low costs.

The connection of electronic circuits and the antenna advantageously allows the realization of an independent sensor. The components and devices placed under the ground plane disrupt the radiation very little.

Figure 14:
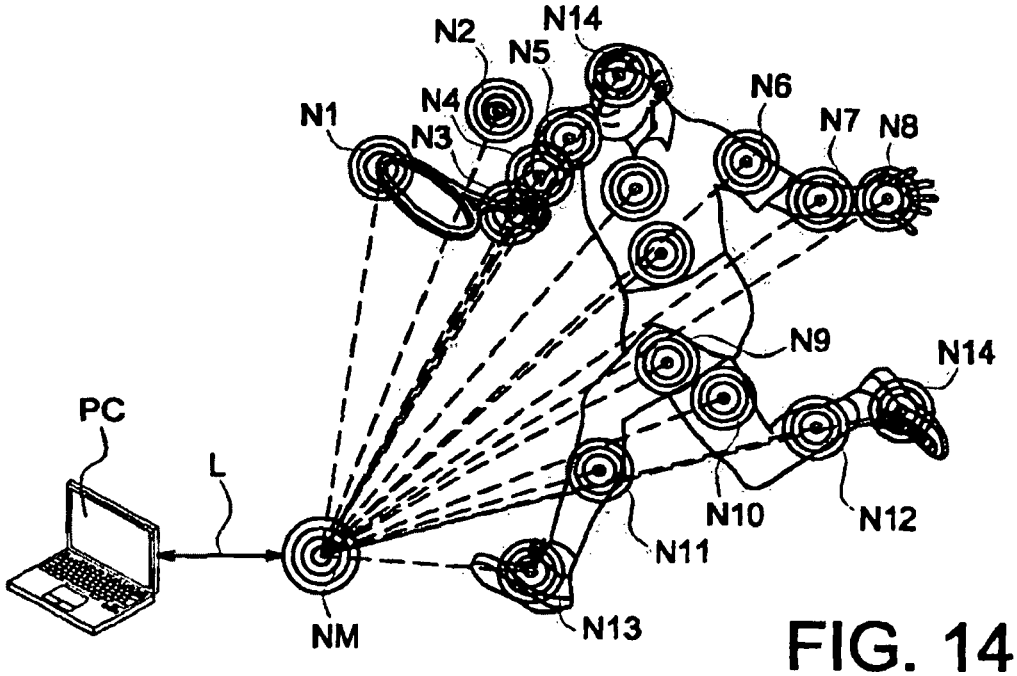
FIG. 14 illustrates an application of the sensor of the invention for sensing motion.

One example of use of the isotropic antenna of the invention will now be described, in the framework of a time division multiple access (TDMA) network, in reference to FIG. 14.

The TDMA network is a star network for sensing motion which comprises a master node NM and a set of slave nodes N1-N14 which are in motion relative to the master node. At each slave node of the network, a sensor is placed which comprises an antenna according to the invention. The slave nodes are distributed as follows:

the node N1 is a point of a tennis racket;

the node N2 is a point of a tennis ball;

the nodes N3-N14 are points of the body of a tennis player.

This star network, orchestrated by the master node, makes it possible to recover, at determined time intervals, the data delivered by the different sensors, the positions of which vary over time.

Each sensor located at a slave node is optimized in terms of size, integration and electrical consumption. It is made up of a physical measurement sensor and its packaging, a processing unit and a radio transmitter/receiver connected to an isotropic antenna according to the invention. Independent, it has an on-board energy source.

The sensor located at the master node is less subject to the size and consumption restrictions, but also has a radio transmitter/receiver and a processing unit. The antenna which equips the sensor located at the master node can be an isotropic antenna according to the invention or a dipolar antenna.

All of the interest of the antenna according to the invention in this context lies in its radiation pattern which covers the entire space, in its circular polarization state which optimizes radio transmission regardless of the tilt of the sensors and in its low bulk in terms of volume.

The antenna according to the invention which equips each sensor located at a slave node has an isotropic radiation in power in all directions and a circular polarization optimized such that there is no direction for which the transmission between a slave node and the master node would be interrupted. The antenna according to the invention equipping the slave nodes is circularly polarized, and the antenna equipping the master node is rectilinearly polarized. Thus, the transmission cannot be interrupted due to polarization mismatching.

The antenna according to the invention increases the overall dimensions of the sensors very little because its planar shape factor provided with a ground plane on one of these surfaces allows easy integration on the sensor. The antenna can be realized with the same printed technology as the rest of the circuit of the sensor. The functions of the sensor and the battery are integrated in a multi-layer under the ground plane of the antenna as previously mentioned.

A description of the operation of the TDMA protocol connecting the master node to the slave nodes will now be provided.

During a nominal cycle of the TDMA network, the master node transmits a timing synchronization word and information sent to the slave nodes, as well as a cyclic redundancy code (CRC). After this the slave nodes transmit, one after the other, their data to the master node as well as a CRC to detect communication errors. When all of the slave nodes have transmitted their data, they can become lethargic until the next cycle in order to increase their autonomy. During this period of time, management of the network can then be done: detection of new slave node, management of communication channels, parameterization of slave nodes.

Due to the isotropy of the antenna which equips them, the sensors of the invention advantageously make it possible to ensure a robust radiofrequency communication link at the position variations. Fewer errors are detected and the use of the retransmission procedure for information is much less necessary, which contributes to optimizing real-time flow and limiting the consumption of the sensors.

Different antennae variations can be realized in the framework of the invention, namely, for example, reconfigurable antennae, diversity antennae or antennae with coverage limited to half-spaces.

Reconfigurable antennae comprise means making it possible to switch phase states. A first phase state can then correspond to a phase progression 0°→90°→180°→270° between the different elementary antennae, while a second phase state corresponds to a phase progression 0°→−90°→−180°→−270° between these same elementary antennae. Phase switching advantageously makes it possible to turn waves with right circular polarization into waves with left circular polarization and vice versa.

In the framework of the invention, the diversity antennae are realized, when the coupling level between elementary TFA antennae allows, by feeding these via two or four independent paths.

The invention claimed is:

1. A device including an antenna operative at a wavelength λ, comprising four elementary IFA antennas, each elementary IFA antenna comprising a ground plane, a roof, a short-circuit between the ground plane and the roof and an excitation means, the four elementary IFA antennas being distributed around an axis in a first set of two IFA antennas having substantially equivalent far field elementary radiations and a second set of two IFA antennas having substantially equivalent far field elementary radiations, the excitation means of the two IFA antennas of the first set being aligned along a first alignment axis substantially perpendicular to the axis and the excitation means of the two IFA antennas of the second set being aligned along a second alignment axis substantially perpendicular to the axis, the first alignment axis and the second alignment axis crossing at a right angle at one point of the axis, the excitation means of the four elementary IFA antennas being fed by radiofrequency signals of like amplitude whereof the phases follow a law which is substantially progressive in quadrature by rotation around the axis (0°, 90°, 180°, 270°), and the diameter of the device including the antenna being less than λ/4.

2. The antenna according to claim 1, in which the two elementary IFA antennas of a same set of two antennas are identical and symmetrical relative to the axis.

3. The antenna according to claim 2, in which the four elementary IFA antennas are all identical.

4. The antenna according to claim 1, in which the roofs of the four elementary IFA antennas are distributed on a flat surface substantially perpendicular to the axis.

5. The antenna according to claim 4, in which the roofs of the four elementary IFA antennas are substantially inscribed in a circle.

6. The antenna according to claim 4, in which the roofs of the four elementary IFA antennas are substantially inscribed in an ellipsis.

7. The antenna according to claim 1, in which the roofs of the four elementary IFA antennas are distributed on a substantially conical closed surface.

8. The antenna according to claim 1, in which the roofs of the four elementary IFA antennas are distributed on a surface whereof the generatrix is parallel to the axis (Oz).

9. The antenna according to claim 8, in which the surface is a cylindrical surface having a cross-section in the form of a circle, or a square, or a rectangle.

10. The antenna according to claim 1, in which the roofs of the four elementary IFA antennas are formed by metallizations realized on a same substrate (S).

11. The antenna according to claim 1, in which the ground planes of the four elementary IFA antennas are formed by a same conductive layer.

12. The antenna according to claim 1 which comprises means for switching the progressive law in quadrature between a first direction of rotation around the axis and a second direction of rotation around the axis, opposite the first direction.

13. The antenna of claim 1, said antenna being coupled to transmitter and a sensor for measuring a measurable quantity, the antenna configured to transmit a measurement of the measurable quantity in the form of a modulation of an electromagnetic wave emitted by the transmitter.

14. Device according to claim 1, in which the size of an antenna is less that λ/5.

15. Device according to claim 1, in which the roofs of the antennae are distributed on a surface perpendicular to the axis, and in which the patterns forming the roofs of the antennae are folded, the short-circuit of each antenna being place at the periphery of the surface and the open-circuit of each antenna being place near the axis.

* * * * *